United States Patent [19]

Fletcher

[11] 4,300,187

[45] Nov. 10, 1981

[54] ADJUSTABLE FLOODLIGHT REFLECTOR

[75] Inventor: Thomas A. Fletcher, Dana, N.C.

[73] Assignee: General Electric Company, Schenectady, N.Y.

[21] Appl. No.: 104,092

[22] Filed: Dec. 17, 1979

[51] Int. Cl.[3] ..... F21S 3/00

[52] U.S. Cl. ..... 362/223; 362/280; 362/347; 362/368

[58] Field of Search ..... 362/277, 280, 223, 347, 362/368

[56] References Cited

U.S. PATENT DOCUMENTS 3,316,398 4/1967 Dayton et al. ..... 362/277

*Primary Examiner*—Stephen J. Lechert, Jr.

*Attorney, Agent, or Firm*—Lawrence R. Kempton; Philip L. Schlamp

[57] ABSTRACT

Floodlight has a reflector mounted for selective adjustment to different positions relative to the light source for providing desired light distribution.

8 Claims, 3 Drawing Figures

ADJUSTABLE FLOODLIGHT REFLECTOR

The present invention relates to lighting fixtures, and particularly to an adjustable reflector for floodlights.

It is an object of the invention to provide an improved mounting for lighting fixture reflectors whereby different light distributions may be readily obtained.

Another object of the invention is to provide an adjustable reflector for floodlights or the like wherein the reflector may be readily adjusted to different selected positions in the floodlight.

Other objects and advantages will become apparent from the following description and the appended claims.

With the above objects in view, the present invention in one of its aspects relates to a floodlight comprising, in combination, a housing having a rear wall and side walls defining an interior chamber and a front opening, the rear wall of the housing having a plurality of spaced projections extending different distances toward the front opening, a concave reflector fitting within the housing chamber and having a rear portion arranged adjacent the housing rear wall, the reflector being selectively positioned in the housing with its rear portion resting alternatively on one of the spaced housing projections, means for securing the reflector in selected position, and means for mounting a light source in the housing within the reflector, whereby the reflector is adjustable to different positions relative to the light source for varying the light distribution of the floodlight.

The invention will be better understood from the following description taken in conjunction with the accompanying drawings, in which.

Figure 1:
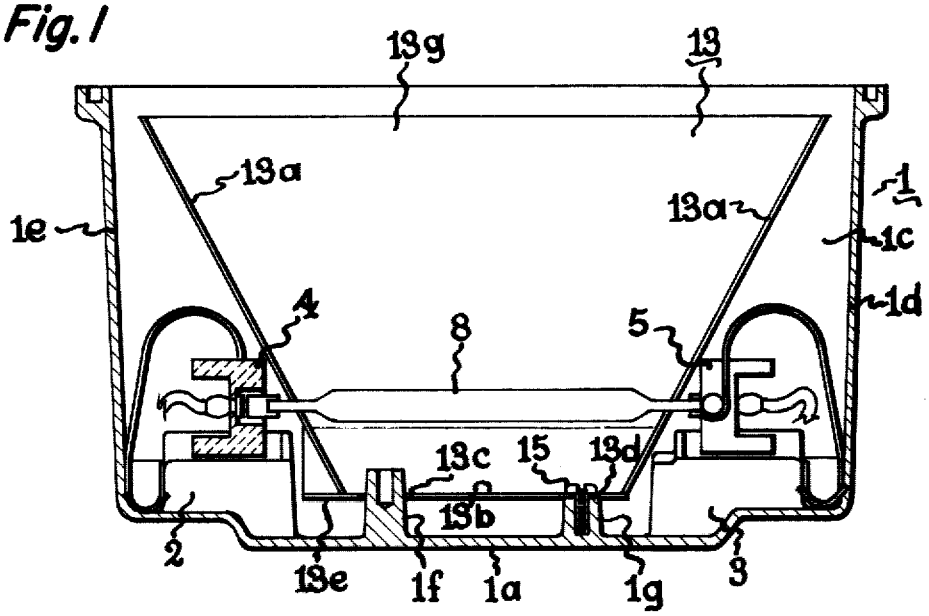
FIG. 1 is a sectional view of a floodlight embodying the present invention, showing the reflector thereof mounted in a particular position relative to the lamp.

Referring now to the drawings, and particularly to FIG. 1, there is shown a floodlight having a generally rectangular housing 1 formed of side walls 1*d*, 1*e*, bottom wall 1*c* and rear wall 1*a* defining an interior chamber and a front opening. The rear housing wall 1*a* is integrally formed with a pair of spaced, generally cylindrical bosses 1*f*, 1*g* projecting toward the front opening of the housing. As shown, boss 1*f* is longer than boss 1*g*, each boss formed with a flat top surface and a screw-receiving recess extending inwardly from the top surface.

Figure 3:
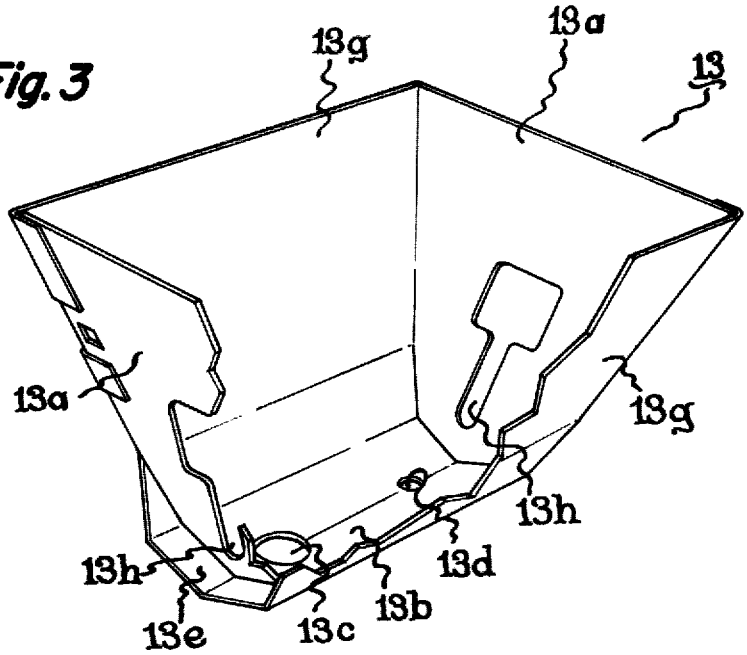
FIG. 3 is a perspective view of the reflector, with parts broken away.

Reflector 13, as seen in FIG. 3, is typically made of aluminum sheet material and formed of four generally trapezoidal sides diverging forwardly from a narrow rear wall 13*b*, and including opposite main walls 13*g* and opposite side walls 13*a*. The sheet may be a single piece of material shaped so that the trapezoidal sides may be folded and snapped into self-locking tabs provided on the edges of the sheet material, so as to provide the reflector form shown in FIG. 3. Rear wall 13*b* has spaced apertures 13*c*, 13*d* and has an extension 13*e*, the function of which is explained hereinafter. The sides of reflector 13 are provided with suitable openings 13*h* to clear the ends of lamp 8 passing through the reflector in different positions thereof.

FIG. 1 shows reflector 13 arranged fitting within housing 1 with the rear wall 13*b* of the reflector resting on top of boss 1*g*, to which it is secured by screw 15 passing through aperture 13*d*. Aperture 13*c* of the reflector is large enough to receive boss 1*f* when the reflector 13 is in the position shown in FIG. 1.

Lamp 8, typically of quartz iodine type, is resiliently mounted at opposite ends on spring-mounted sockets 4 and 5 arranged behind the reflector walls, so that the lamp is arranged at a predetermined position relative to the reflector.

The spring-mounted socket assemblies are disclosed in detail in the co-pending application of Fletcher et al., Ser. No. 104,093, filed Dec. 17, 1979 and assigned to the same assignee as the present invention, but those devices form no part of the present invention. Other features of the floodlight structure are also more specifically disclosed in the aforementioned co-pending application, and the disclosure thereof is accordingly incorporated by reference herein.

To arrange reflector 13 in a different position within the floodlight housing relative to the lamp, after removing lamp 8, reflector 13 is detached from short boss 1*g*, withdrawn from the housing, and rotated 180° before being re-inserted into the housing with aperture 13*d* in its rear wall 13*b* aligned with the recess in long boss 1*f*, and with rear reflector wall 13*b* in this region resting on long boss 1*f*, the reflector is secured to the latter boss by screw 15. Lamp 8 is then replaced.

The parts are preferably so dimensioned that in the rearward position of reflector 13 shown in FIG. 1, at least a portion of the main walls 13*g* of the reflector rest against the top and bottom walls of housing 1 and such contact, together with the attachment of the reflector rear wall to boss 1*g*, provides adequate stability of the reflector within the housing.

Figure 2:
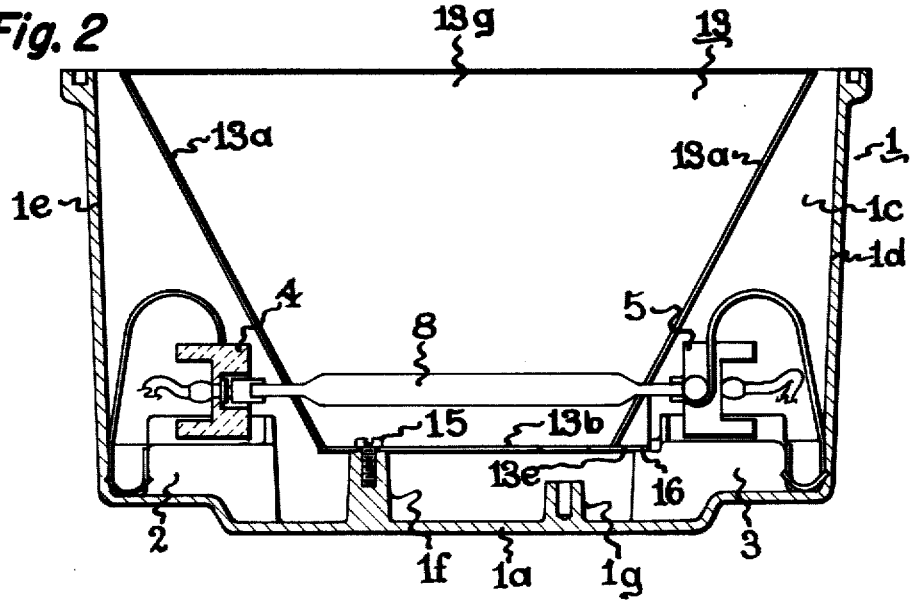
FIG. 2 is a similar view, showing the reflector mounted in a different position relative to the lamp.

When reflector 13 is mounted in the forward position shown in FIG. 2, such contact with the top and bottom housing walls does not occur. Accordingly, to ensure adequate stability for the reflector in this position, extension 13*e* is provided on the reflector rear wall so that the extension rests on a ledge 16 formed on the inner side of socket guide portion 3 of housing 1, the ledge being substantially co-planar with the top of boss 1*f* on which the reflector rear wall rests.

The form of reflector 13 is such that its opposite main walls and rear wall approximate the shape of a parabola in vertical section. In the forward position of reflector 13 shown in FIG. 2, lamp 8 is typically located approximately at the focus of the parabola, and as a result the reflected light rays are parallel in a vertical plane.

In the rearward position of reflector 13 shown in FIG. 1, the focal point of the parabolic reflector would be substantially rearward of lamp 8, and as a result, a vertically divergent beam would be produced, thus providing a greater vertical spread of light than obtained with the FIG. 2 arrangement.

It will be understood that the form of the reflector may be different from that shown without departing from the principles of the invention.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A floodlight comprising, in combination, a housing having a rear wall and side walls defining an interior chamber and a front opening, said rear wall of said housing having different portions arranged at different distances from said front opening, a reflector fitting within said housing chamber and having a rear portion arranged adjacent said housing rear wall, said reflector being selectively positioned in said housing with its rear portion resting alternatively on one of said different portions of said housing rear wall, means for securing said reflector in selected position, and means for mounting a light source in said housing between said reflector and said front opening, whereby said reflector is adjustable to different positions relative to the light source for varying the light distribution of the floodlight.

2. A floodlight as defined in claim 1, said different housing portions comprising a pair of spaced projections of different length extending from said housing rear wall toward said front opening.

3. A floodlight as defined in claim 2, said reflector being concave.

4. A floodlight as defined in claim 3, said rear reflector portion having a pair of spaced apertures in register with said spaced housing projections.

5. A floodlight as defined in claim 4, said reflector rear portion having an extension at one side, said housing having ledge means adjacent its rear wall, said reflector in one of said positions resting at its rear portion on the shorter of said housing projections and engaging at least certain of said housing side walls, said reflector in another of said positions resting at its rear portion on the longer of said housing projections and said extension thereof resting on said housing ledge means.

6. A floodlight as defined in claim 1, said reflector being substantially of parabolic form, the light source in one of said reflector positions being approximately at the focus of said parabolic reflector and in another of said reflector positions being substantially spaced from said focus thereof.

7. A floodlight as defined in claim 4, one of said spaced reflector apertures being sufficiently large to clear the longer of said spaced housing projections.

8. A floodlight as defined in claim 3, said reflector having opposite main walls and opposite side walls, said mounting means comprising lamp socket means arranged in said housing rearward of said reflector side walls, said reflector side walls formed with apertures for passage of the ends of an elongated lamp therethrough, said apertures formed to clear the lamp ends in said different positions of said reflector.

* * * * *